United States Patent [19]

Howey

[11] Patent Number: 4,586,606

[45] Date of Patent: May 6, 1986

[54] NONWOVEN FABRIC

[75] Inventor: Jon A. Howey, Mansfield, Mass.

[73] Assignee: The Kendall Company, Boston, Mass.

[21] Appl. No.: 546,785

[22] Filed: Oct. 28, 1983

[51] Int. Cl.[4] ..... B65D 85/30

[52] U.S. Cl. ..... 206/313; 206/444; 428/171; 428/172; 428/198; 428/284; 428/287; 428/296

[58] Field of Search ..... 428/284, 286, 287, 296, 428/195, 198, 171, 172, 298, 156; 206/313, 444

[56] References Cited

U.S. PATENT DOCUMENTS

| | | | |
|---|---|---|---|
| 3,765,997 | 10/1973 | Dunning | 428/296 |
| 3,916,447 | 11/1975 | Thompson | 428/284 |
| 4,211,227 | 7/1980 | Anderson et al. | 428/198 |

*Primary Examiner*—James J. Bell

*Attorney, Agent, or Firm*—Edward J. Scahill, Jr.

[57] ABSTRACT

Nonwoven fabrics are described comprising a layered fabric having an inner layer of substantially thermoplastic material, for example fibers, disposed adjacent and thermally bonded to at least one outer layer or a pair of outer layers of textile length fibers by means of heat and pressure. The thermoplastic fibers in the inner layer have a lower melting point than any other fibers in the fabric. A nonwoven fabric constructed in this manner has qualities of; low levels of debris, high compressibility, low abrasiveness, and dimensional stability. These qualities are decidedly of use in many products, most particularly in computer diskettes, wherein a material must be used to wipe the magnetic disk within the computer diskette to keep it free of foreign particles, which may cause errors in the transfer of information onto or from the magnetic disk.

15 Claims, 6 Drawing Figures

NONWOVEN FABRIC

BACKGROUND OF INVENTION

This invention relates to a nonwoven fabric used as a wiping medium of a magnetic recording medium known as a computer diskette, which comprises a flexible magnetic recording disk contained in an envelope, having a wiping fabric attached therein.

The importance of nonwoven fabrics in computer diskettes is now recognized as being more than a protective fabric to minimize wear or abrasion of the magnetic media. The wiping action of the fabric is important to the function of the floppy disk medium which stores information for use in a disk drive. The wiping action of the fabric is also important because debris that may interfere with the information transfer at the read-write head of the computer disk drive, is ideally removed and entrapped by a wiping fabric. Debris originates from many sources such as; the diskette manufacturing process; the envelope itself; the action of the read-write head on the magnetic disk; external environment; and, abrasion of the magnetic disk, caused by abrasive fibers used in making nonwoven wiping fabrics.

While there is a demonstrated need for a wiping medium to keep the magnetic disk clean in order to reduce errors in the transmission of information onto or from said magnetic disk, the prior art does not indicate what characteristics are needed in a wiping fabric to perform this task.

The fabric that would perform such a task must be constructed in such a manner that fibers used in the fabric would not themselves produce debris in the process of making the fabric. The fibers used therein should not be abrasive to the magnetic disk in which it would come in contact. If debris created by abrasion is not removed or if the wiping fabric abrades the magnetic disk producing foreign particles then said foreign particles will impinge upon the surface, or remove the surface of the magnetic disk. Such abrasion or removal of the surface causes errors in the information that is being transferred from or onto a magnetic disk, and a misreading of said information would take place.

U.S. Pat. No. 3,668,658 discloses a magnetic record disk cover wherein any porous low friction anti-static material is used to wipe the surface of the magnetic media.

In addition, U.S. Pat. No. 4,239,828 discloses a self-lubricating magnetic recording diskette, wherein a nonwoven porous tissue-like material is impregnated with a specific additive to lubricate the surface of the magnetic media to prolong the life of the disk.

Although the prior art outlines the need for a wiping fabric to keep the magnetic disk or media used in computer diskettes free from foreign particles in order to reduce errors in information transfers, it is only concerned with enveloping the magnetic disk in a cover to reduce the amount of external contamination that may settle on the magnetic record surface, or the lubricating of the surface of the magnetic disk to reduce contamination and extend the life of said magnetic disk. However, the prior art does not take into account other problems that exist in providing error free performance in the transfer of information onto or from a magnetic disk. There is also a problem of debris caused by loose particles inherent in the use of certain fibers in nonwoven fabrics that may be used as wiping mediums in a recording diskette. Another problem is caused by abrasiveness in the pressure pad area of the computer diskette. For the purpose of this invention a pressure pad is defined as an external mechanism which is part of the information recording system being used. One such system operates by sending an electric impulse to a solenoid, which in turn moves a pressure pad into a position adjacent the read-write head of the computer disk drive and puts it in contact with the computer diskette, thereby exerting pressure onto the diskette envelope and pushing the envelope and attached wiping medium onto the magnetic medium, allowing the wiping medium to clean the magnetic disk, while information is being transferred. The pressure pad exerts substantial pressure on the wiping fabric, which is in contact with the magnetic disk's surface, in order to entrap debris created by the read-write head. The pressure exerted by the pressure pad presents a problem. This problem develops when pressure exerted by the pressure pad on the computer diskette is transferred to the wiping fabric. This combination of force and fabric friction within a computer diskette may possibly slow the magnetic disk, thus causing poor transfer of information from the recording system to the disk. Additionally, as mentioned before hand, the pressure of the read-write head on the magnetic disk contributes to abrasion of said disk due to the numerous cycles that the disk has to go through with the read-write head pressing down on said magnetic disk causing debris. Another problem that exists in wiping fabrics, which is caused in the production of these fabrics, is dimensional creep. Dimensional creep is a disadvantage because it changes dimensions of a fabric for example; dimensional creep exists when a fabric is altered, by cutting it while it is under tension. If the fabric remains under tension its dimensions remain the same as they were when cut. Once the tension is removed from the fabric and it relaxes, its dimensions change due to the fabric's memory of what its dimensions were prior to being put under tension. Thus when the fabric is cut to mate with diskette components it does not retain its dimensions after the tension is removed, and may be rejected. The present invention substantially overcomes all the disadvantages prevalent in the prior art by providing a fabric that significantly reduces errors in the transmission of information onto or from a computer magnetic disk, by reducing foreign contamination and providing a fabric that is: substantially free of fiber debris; non-abrasive; highly compressible; and has dimensional stability. These characteristics are needed in a liner fabric, to overcome problems associated with providing error free transfer of information from or onto a magnetic disk.

SUMMARY OF THE INVENTION

The present invention is a nonwoven fabric comprising an inner layer of substantially low melting thermoplastic material, such as fibers disposed adjacent, and thermally bonded to, at least one outer layer of substantially non-thermoplastic textile length fibers. This particular type of layered construction advantageously results in a fabric wherein the lower melting point thermoplastic fibers bond themselves and the non-thermoplastic textile length fibers or combinations thereof together at several discrete bonding points by heat and pressure or other similar bonding methods. During the bonding process, only the low melting thermoplastic material melts and bonds the non-thermoplastic textile length fibers together at bond points which may be recessed beneath or below the outer surface of the fabric. Therefore, because the non-thermoplastic textile length fibers do not melt, the softer textile fibers are left essentially untouched and in position at the outer surface of the fabric outside the bond points, giving the fabric a structure which is lofty and soft. Enhanced softness of the fabric can be achieved with the use of non-thermoplastic textile length fiber having the delusterant removed therefrom.

An object of this invention is to provide a fabric that is substantially free of debris.

Still another object is to provide a fabric whose dimensions remain stable after being cut under tension, thus reducing dimensional creep and fabric waste.

In addition another object is to provide a fabric with high compressibility that will distribute the pressure pad load more evenly, substantially minimizing wear of the magnetic media and reducing abrasive contact.

It is still another object to provide a fabric with low surface resistivity, thus reducing the buildup of static electricity within the rotating magnetic disk.

Another object is to provide a fabric having at least 75% void volume, which allows for the entrapment of external dirt and debris.

DESCRIPTION OF THE PREFERRED EMBODIMENTS

Figure 1:
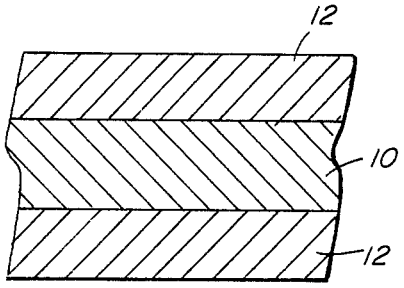
FIG. 1 is a cross sectional view of the layered structure of the invention prior to bonding.
Figure 2:
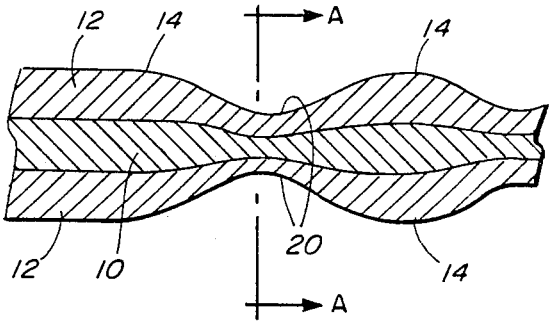
FIG. 2 is a cross sectional view of the fabric of the invention after bonding has occurred.

Referring to the drawings, FIG. 1 shows such a layered fabric wherein an inner layer of substantially thermoplastic material, such as fibers 10, has at least one outer layer 12 of substantially textile length cellulosic fibers or a combination of synthetic and cellulosic fibers in bonded contact therewith. As shown, the preferred fabric has an outer layer 12 disposed on either side of inner layer 10. The thermoplastic fibers of said inner layer 10 have a lower melting point than the non-thermoplastic textile length fibers in said outer layer(s). Non-thermoplastic textile length fibers are selected from the group comprised of rayon, cotton, and other celluosic fibers. The fabric may also be of a blend of thermoplastic and non-thermoplastic fibers. The layers are bonded together at various discrete bonding points by various methods including but not limited to, heat and pressure or ultrasonics. During the bonding procedure, sufficient heat is used to cause a melting or softening of a majority of the low melting thermoplastic fibers in said inner layer, while not so high as to affect the fibers in the outer layer or layers. Fiber displacement pattern formed by bonding is shown in FIG. 2 wherein bonding areas 20 are disclosed.

While FIG. 1 shows the preferred embodiment of an inner layer of substantially thermoplastic fibers sandwiched between a pair of outer layers of non-thermoplastic textile length fibers it should be understood that a single outer layer can be successfully used herein with similar although perhaps somewhat less desirable results.

This unique liner construction described above results in a fabric that has low levels of debris, high compressibility, low abrasiveness, dimensional stability, and low surface resistivity. These characteristics are highly desirable in a wiping fabric used in the computer industry. More particularly, they are desirable in a computer diskette liner whose purpose is to reduce errors in the transfer of information to or from a computer magnetic disk by wiping clean the surface of the magnetic disk. The present invention is a significant advance in the diskette liner field, because none of the aforementioned characteristics are even discussed in the prior art.

Figure 3:
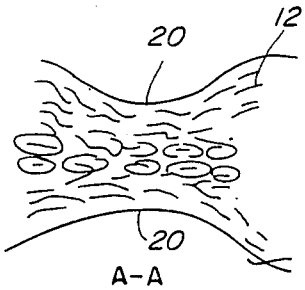
FIG. 3 is a sectional view of FIG. 2 along A—A.

As mentioned previously, this fabric has a structure which results in a lofty and soft fabric. Advantages of the fabric being lofty and soft are many, such as: the fabric is suitable to clean a magnetic disk in a computer diskette of foreign particles; the fabric is also substantially nonabrasive to the magnetic disk, because the non-thermoplastic fiber that comes in contact with the surfaces of the magnetic disk has unmelted nonabrasive qualities; this fabric may be compressed giving excellent contact between the wall of the diskette envelope and the magnetic disk without exerting excessive pressure against either the envelope or the disk. Because the outer surfaces of the fabric are not themselves bonded but are only bonded at recessed bond points due to the lower melting fibers in said inner layer, the fabric is allowed to remain lofty thus giving the fabric compressibility. This is a desired characteristic because the fabric may be compressed to fit in a particular computer diskette envelope. An envelope for the purpose of this invention may be defined as a container housing flexible magnetic media. As a result of compressibility of the fabric, low pressure is exerted between the envelope and the magnetic disk. If high pressure were to be used, abrasion of the magnetic media by the liner could take place. One further advantage of this construction is the resulting low levels of debris in the fabric due to the way it is bonded. The recessed bonding areas of the low melting thermoplastic fibers to the non-thermoplastic fibers hold the inner and outer layers together allowing substantially no debris from the fabric. This is illustrated in FIG. 3.

Figure 5:
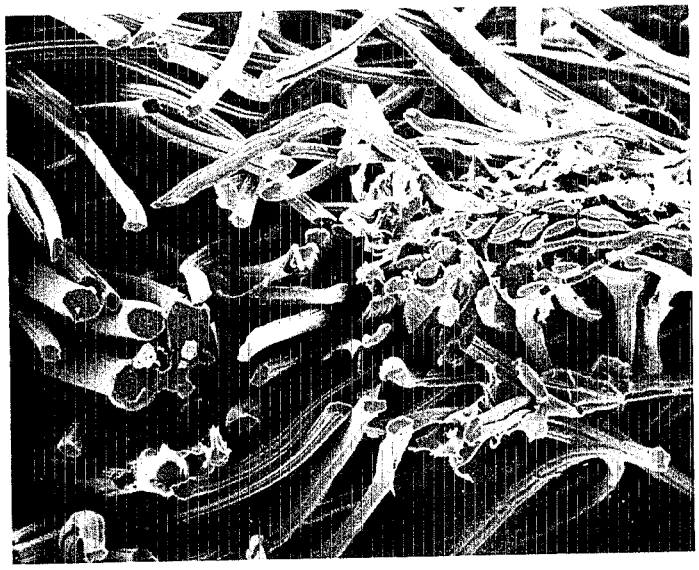
FIG. 5 is a micro photograph illustrating the bonding of fibers.
Figure 6:
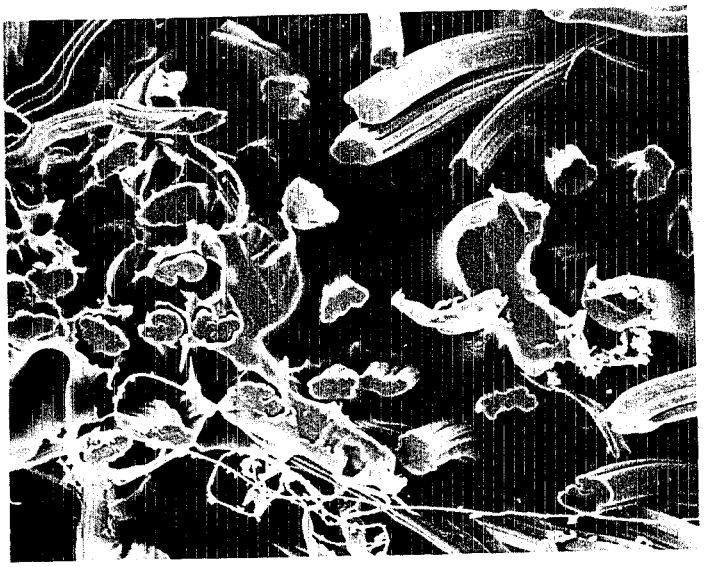
FIG. 6 is a micro photograph illustrating the bonded and unbonded areas of the fabric.

An unexpected result of this invention, created by its unique structure is the capability of this fabric to have at least a 75% void volume which allows for the entrapment of dirt and debris. By having such a large void volume, additional assistance in reducing errors in transmitting of information is achieved. This is illustrated in FIGS. 5 and 6. Void volume as herein used, may be defined as the open space between fibers.

The importance of this soft, lofty, non-abrasive, dimensionally stable, compressible, low level debris fabric is readily noticeable in the computer industry because without a fabric having these qualities, errors would occur in the transmission of information from or to a computer diskette which would wreak havoc among the users of computer diskettes. If significant errors in transmitting do take place, it becomes obvious that information being transferred may become lost and not recoverable, or it is distorted on the recording medium. The present invention fabric substantially decreases the cause of errors thus giving virtually an error free performance to the user.

Figure 4:
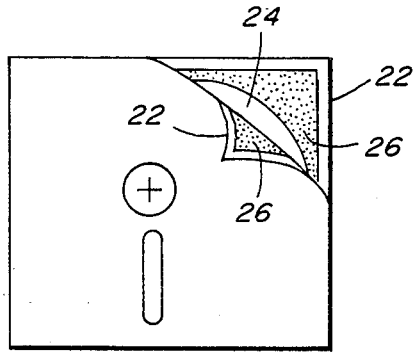
FIG. 4 shows the fabric of this invention in place in a computer diskette.

To assist in understanding the function of the present invention, a description of a computer diskette as illustrated in FIG. 4 is given. A computer diskette is comprised of a plastic outer envelope or jacket 22, a magnetic disk 24 and the nonwoven liner 26 of this invention attached to the envelope. The diskette is used as a recording medium to record information, similar to a cassette tape used in tape recorders. The magnetic disk 24 is sandwiched between two nonwoven liners 26 while the envelope 22 encloses these components to keep out contamination.

The purpose of layering and bonding as hereinbefore described and shown in the drawings is to isolate the abrasive bonded and melted thermoplastic fibers 10, as illustrated in the drawings, away from the surface of the fabric so as to eliminate any possibility of abrasion of the surface of a computer magnetic disk by the liner fabric. The thermoplastic fibers 10 are isolated by a recessed bonding technique, wherein, for example specific heat and pressure levels are applied to the layered construction, causing the inner layer of low melting fibers 10 to melt and encapsulate the non-thermoplastic textile length fibers 12 used in the outer layers, as illustrated in FIG. 5, a micro photograph of the present fabric. This phenomenon takes place only in the areas where the fabric is recessed, further illustrated in FIG. 6, a micro photograph of a cross sectional area of the present fabric. The reason this happens in the recessed bond areas is due to the fact it is the only place where the combination of heat and pressure is present. At the raised areas 14 or nonrecessed outer layers of the fabric only regulated levels of heat comes in contact with the fibers, thus, causing little, if any, physical change at the raised areas of the fabric. This selective recessed bonding technique therefore leaves the soft unmelted textile length fibers 12 at the surface of the fabric, a construction which allows only the soft textile length fibers 12 to come in contact with the surface of a magnetic disk 24 while the melted and abrasive bonding fibers are recessed away from the disk surface. As expressed previously, this is important, because it allows the lofty and soft fabric to more efficaciously clean the surface of the magnetic disk while not abrading its surface.

Another important result due to this construction is that non-thermoplastic textile length fibers are bonded together at discrete recessed bond points, by the thermoplastic fibers being softened or melted by heat and pressure, thus securing the thermoplastic and non-thermoplastic textile length fibers, together at the bond points, thereby, substantially reducing any fiber debris that usually results when producing nonwoven fibrous material.

FIG. 2 is a cross sectional view of the bonded fabric wherein it is shown that the thermoplastic fibers 10 are or remain sandwiched between the outer layers of the non-thermoplastic textile length fibers 12. The compacted area 20 of FIGS. 2 and 3 shows the three layers of fiber compacted together by heat and pressure and bonded at discrete bonding points. This is further illustrated in FIG. 6. However, it should be noted that outer layer 12 remains uncompacted, between the recessed bond points. FIG. 3 is a cross sectional view which also gives a magnified view of FIG. 2 to further illustrate how the non-thermoplastic textile length fibers 12 are bonded by the low melting point thermoplastic fibers 10.

In addition to FIG. 3, FIG. 5, a micro photograph, illustrates further, how the low melting point thermoplastic fibers 10 encapsulate adjacent non-thermoplastic fibers 12, when they melt.

Another important factor of this layered fabric construction is that delamination of the fabric has virtually been eliminated. Delamination of a fabric is a result of insufficient bonding taking place within a fabric, and as a result the layers of fabric tend to separate. When heat and pressure are applied to the present fabric, there should be approximately 10% to 40% of the surface area of the fabric recessed bonded then said heat and pressure will bond all layers of the fabric together. This is a distinct advantage over other prior art nonwoven fabrics. Other fabrics have delaminated due mainly to the fact that insufficient melting of the inner layer fibers of other prior art fabrics results in poor bonding of inner and outer layers of fibers.

In addition, a fabric constructed having only one outer layer, would allow the lower melting thermoplastic inner layer (away from the surface of the magnetic media) to not only be bonded to the outer layer of textile fibers but the thermoplastic fibers may be more readily and directly bonded to, for example, a polyvinyl chloride film such as used as the substrate in a diskette envelope. This bonding of the fabric directly to the polyvinyl chloride (PVC) film is due to the low melting thermoplastic fibers of the inner layer of the fabric being put in contact with the surface of the PVC film while the non-thermoplastic fibers of the outer layer are away from the surface of the PVC film. Therefore, when heat and pressure are applied to the fabric while adjacent the PVC film the thermoplastic fibers readily adhere themselves to the surface of the PVC film.

FIG. 4 shows a section of a typical finished computer diskette product to illustrate the preferred position of the present fabric 26 in relationship to the magnetic disk 24 and diskette envelope 22.

As shown in FIG. 4, the fabric is located on at least one side of the magnetic disk 24 and because of its compressible quality will fill the diskette envelope 22 without undue pressure being exerted on the fabric. This compressibility also works in favor of reducing the torque which is required to rotate the magnetic disk 24 in a disk drive. As previously stated, because the fabric is compressible it follows the contours of the envelope and magnetic disk without imposing high pressure upon the disk which pressure would have to be overcome by increasing the torque of the driving mechanism to drive said disk. With the non-thermoplastic textile length fibers, which have low surface resistivity, against the magnetic disk low torque can be used in the drive system. Fibers with low surface resistivity are fibers that are hydrophilic or hydrophilicly treated.

In addition, as shown in FIG. 4, the diskette envelope 22, magnetic disk 24 and fabric liner 26 are integral and congruent with each other, which means that each component has dimensions that have to be held in order for them to fit together. It is usually easy to hold the dimensions of a computer diskette envelope 22 and a magnetic disk 24 because they have substantial body, but it is difficult to hold liner fabric 26 dimensions due to its flexibility. The present invention overcomes this problem because it has dimensional stability. Dimensional stability means when the liner fabric 26 is cut to a specific dimension, a dimension needed to mate with the adjacent envelope 22 or magnetic disk 24 components, the liner fabric 26 will retain these dimensions or shape during subsequent use, where most other fabrics may have dimensional creep. As previously discussed dimensional creep takes place after the liner fabric 26 is cut and the tension is removed. It is minimized with the present fabric because great care is taken in the production of the fabric to insure that it is made with a minimum of tension. To achieve a minimum amount of tension in the production of the liner fabric, all process equipment used in said production is operated at substantially the same line speed.

One other important characteristic of this fabric is the low surface resistivity of its fibers. Low surface resistivity is the ability of the outer surface non-thermoplastic textile length fibers to adsorb or absorb moisture. The non-thermoplastic fibers in the present invention have this ability.

This ability to adsorb or absorb moisture is important because when there is moisture in or on the fibers, static electricity does not develop. Static electricity develops in a computer diskette when a magnetic disk is rotated against a stationary fabric liner, which has no moisture adsorbtion or absorbtion ability.

If static electricity is developed within the computer diskette it may interfere with the transfer of information to or from a magnetic disk.

With the advent of the present invention, and the ability of its fibers to adsorb or absorb moisture, static electricity within the computer diskette is eliminated.

It is assumed and may be demonstrated, by using fibers that do not have titanium dioxide or other delusterants in the fibers, that abrasion of the magnetic disk may be minimized.

Typical examples are described of the preferred embodiment of this invention. These examples are illustrative of the fabrics of this invention, noting that the cellulosic fibers, or outer layers of the fabric are intended to be positioned against the magnetic media.

Example 1—an array of fibrous layers comprising a pair of outer or surface layers, of 100%, 1.5 denier, 2 inch staple, rayon fiber with a soap finish, for ease of handling and containing no titanium dioxide, is sandwiched around a blended inner core layer of 50%, 1.5 denier, 2 inch staple rayon fiber and 50% Eastman type 438 binder fiber with a melting point of 265° F. Eastman Type 438 binder fiber is a 3 denier, 1.5 inch staple fiber of modified polyethylene terephthalate fiber, sold by Eastman Chemical Products of Tennessee. The array is then thermally bonded at discrete recessed bonding points with a combination of 450° F. heat and 50 pounds per liner inch (PLI) pressure. The fabric has a dwell time of $5.5\times10^{-4}$ seconds in contact with said heat and pressure. The resulting fabric weighs approximately 44 grams per square yard, and has a thickness of 325 microns at zero load. Zero load on a fabric, simply means no external force (load) has been applied on the surface of the fabric. The fabric is capable of being compressed approximately 25% in thickness to 250 microns when a load of 187 grams per square centimeter is applied to the surface of the fabric.

Example 2—an array of fibrous layers comprising an outer layer or surface layer of 100%, 1.5 denier, 2 inch staple, rayon fiber with a soap finish, and containing no titanium dioxide, with a blended inner layer of 60%, 1.5 denier, 1.5 inch staple polyester fiber with a melting point of 482° F. and 40%, 2.25 denier, 1.5 inch staple, polyester binder fiber with a melting point of 265° F. The composite is then thermally bonded at discrete recessed bonding points with a combination of 450° F. heat and 50 PLI pressure. The fabric has a dwell time of $3.5\times10^{-4}$ seconds in contact with said heat and pressure. The resulting fabric weighs 35 grams per square yard, and has a thickness of 250 microms, at zero load. This fabric is capable of being compressed uniformly approximately 25% in thickness to 175 microns when a load of 187 grams per square centimeter is applied to the surface of the fabric.

Example 3—an array of fibrous layers comprising a pair of outer or surface layers of 60%, 1.5 denier, 1 9/16 inch staple, rayon fibers and 40%, 1.5 denier, 1.5 inch staple, polyester having a melting point of 482° F. sandwiched around a blended inner core layer of 60%, 1.5 denier, 1.5 inch staple, polyester with a melting point of 482° F. and 40% 2.25 denier, 1.5 inch staple, polyester binder fiber with a melting point of 265° F. The array is then thermally bonded at discrete bonding points with a combination of 440° F. heat and 100 PLI pressure. The fabric has a dwell time of $4.8\times10^{-4}$ seconds in contact with said heat and pressure. The weight of the fabric is 65 grams per square yard, and has a thickness of 900 microns, at zero load. This fabric is capable of being compressed approximately 42% in thickness to 520 microns when a load of 73 grams per square centimeter is applied to the surface of the fabric; this particular fabric may also be compressed to a thickness of 420 micron when a load of 187 grams per square centimeter is applied, further illustrating the compressability of this fabric.

Each previously mentioned example was tested under the same exact conditions to determine the effect each had on reducing errors generally encountered in transferring information to or from a magnetic disk. Before testing the fabric against a magnetic disk, each disk to be used in the test was subjected to a test using a "Diskette Analysis System," made by Cloutier Design Services, to determine whether errors were inherent in the disk. Each disk tested proved to be error free. After making this assessment, the fabric in each example was laminated to a polyvinyl chloride (PVC) sheet, which is typical of the medium used in making a diskette envelope, and then the laminated unit was inserted into a simulated diskette drive system, along with the magnetic disk in contact therewith. The criteria the sample fabric must meet was established by ANSI (American National Standards Institute). Specifically the standard includes the wear resistant specifications of Paragraph 4.4.3 of the 4th draft of ANSI for (2) two sided double density unformulated 5.25 inch flexible disk cartridges, general, physical and magnetic requirements number X 3B 8/82—08. ANSI Standard 4.4.3 was followed, with one exception. This exception was that the read-write head was not loaded on the disk. All tests were conducted for a 500 hour period which is equivalent to 9 million revolution, at 300 RPMS.

Each test result showed that the fabric kept the magnetic media free from errors. Each sample fabric and magnetic disk then was examined under a microscope to see if the fabric abraded the surface of the disk, and whether the disk was damaged. The examination results showed no abrasion or damage.

The conclusion arrived at after testing was that the fabric cleaned the magnetic media of contamination; the fabric did not contain debris; and the fabric did not abrade the surface of the disk.

The above disclosure is not meant to be limited except by the attached claims.

What is claimed is:

1. A computer diskette liner material comprising; an inner layer of substantially low melting point thermoplastic fibers, and at least one outer layer of predominately non-thermoplastic textile length fibers, said inner and outer layers thermally bonded together only in a plurality of recessed discrete bonding points.

2. The computer diskette liner material of claim 1 wherein said inner layer is of low melting thermoplastic fibers consisting of synthetic fibers, or a blend of synthetic and natural fibers.

3. The computer diskette liner material of claim 1 wherein said outer layer is comprised of cellulosic fibers or a blend of cellulosic and synthetic fibers.

4. The computer diskette liner material of claim 1 wherein the surface of all the fibers used in said material are substantially free of delusterant.

5. The computer diskette liner material of claim 1 wherein said material has at least a 75% void volume.

6. The computer diskette liner material of claim 1 wherein said material has 10%–40% of its surface area bonded.

7. In a computer diskette having a flat plastic container, a nonwoven fabric liner disposed therein, and a flexible magnetic disk dispqsed thereon, in surface contact with said nonwoven liner, wherein the improvement comprises: a nonwoven liner having an inner layer of substantially low melting point thermoplastic fibers; and at least one outer layer of predominantely non-thermoplastic textile length fibers, said inner and outer layers thermally bonded together only in a plurality of recessed bonding points.

8. The nonwoven fabric liner of claim 7 wherein said fabric has at least a 75% void volume.

9. The nonwoven fabric liner of claim 7 wherein said fabric has 10%–40% of its surface area bonded.

10. A recording medium wiping fabric comprising: an inner layer of substantially low melting point thermoplastic fibers, and at least one outer layer of predominantely non-thermoplastic textile length fibers, said inner and outer layers thermally bonded together only in a plurality of recessed bonding points.

11. The recording medium wiping fabric of claim 10 wherein said low melting thermoplastic fibers consist of synthetic fibers or a blend of synthetic and natural fibers.

12. The recording medium wiping fabric of claim 10 wherein said outer layer is comprised of cellulosic fibers or a blend of synthetic fibers and cellulosic fibers.

13. The recording medium wiping fabric of claim 10 wherein all fibers are substantially free of delusterant.

14. The recording medium wiping fabric of claim 10 wherein said fabric has at least a 75% void volume.

15. The recording medium wiping fabric of claim 10 wherein said fabric has 10%–40% of its surface area bonded.

* * * * *